US009670873B2

(12) United States Patent
Lee

(10) Patent No.: US 9,670,873 B2
(45) Date of Patent: Jun. 6, 2017

(54) ENGINE SYSTEM HAVING COOLANT CONTROL VALVE

(71) Applicant: Hyundai Motor Company, Seoul (KR)

(72) Inventor: Hyo Jo Lee, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 153 days.

(21) Appl. No.: 14/799,009

(22) Filed: Jul. 14, 2015

(65) Prior Publication Data

US 2016/0138530 A1 May 19, 2016

(30) Foreign Application Priority Data

Nov. 18, 2014 (KR) ..... 10-2014-0160899

(51) Int. Cl.

| | |
|---|---|
| ***F02F 7/00*** | (2006.01) |
| ***F02M 26/22*** | (2016.01) |
| ***F01P 7/16*** | (2006.01) |
| ***F02M 26/23*** | (2016.01) |
| *F01P 3/02* | (2006.01) |

(52) U.S. Cl.

CPC ..... *F02F 7/007* (2013.01); *F01P 7/165* (2013.01); *F02M 26/22* (2016.02); *F02M 26/23* (2016.02); *F01P 2003/027* (2013.01); *F01P 2060/04* (2013.01); *F01P 2060/08* (2013.01); *F01P 2060/16* (2013.01)

(58) Field of Classification Search

CPC . F02F 7/00; F02F 7/007; F02M 26/22; F02M 26/23; F01P 7/165

See application file for complete search history.

(56) References Cited

U.S. PATENT DOCUMENTS

| | | | | |
|---|---|---|---|---|
| 8,869,757 | B2 * | 10/2014 | Kim | F01P 7/165 123/41.12 |
| 2016/0245128 | A1 * | 8/2016 | Shintani | F01L 1/34 |
| 2016/0258341 | A1 * | 9/2016 | Yoon | F01P 7/16 |

FOREIGN PATENT DOCUMENTS

| | | | |
|---|---|---|---|
| JP | 2005-61417 | A | 3/2005 |
| JP | 2012-241610 | A | 12/2012 |
| JP | 2013-19313 | A | 1/2013 |
| JP | 2013-224643 | A | 10/2013 |

* cited by examiner

*Primary Examiner* — Hieu T Vo

(74) *Attorney, Agent, or Firm* — Morgan Lewis & Bockius LLP

(57) ABSTRACT

An engine system having a coolant control valve may include a cylinder block configured with cylinders, a cylinder head sitting on top of the cylinder block and comprising exhaust ports and intake ports configured to lead to the cylinders, an Exhaust Gas Recirculation (EGR) cooler, a heater core, an oil cooler, or a radiator through which coolant circulates, and a coolant control valve configured to control a coolant supplied to the cylinder block, a coolant discharged from the cylinder block through the cylinder head, and a coolant supplied to the EGR cooler, the heater core, the oil cooler, or the radiator.

11 Claims, 4 Drawing Sheets

ENGINE SYSTEM HAVING COOLANT CONTROL VALVE

CROSS-REFERENCE TO RELATED APPLICATION

The present application claims priority to Korean Patent Application No. 10-2014-0160899 filed Nov. 18, 2014, the entire contents of which is incorporated herein for all purposes by this reference.

BACKGROUND OF THE INVENTION

Field of the Invention

The present invention relates to an engine system having a coolant control valve that can improve overall cooling efficiency and reduce fuel consumption by controlling both a coolant supplied to a cylinder block and a coolant discharged from a cylinder head.

Description of Related Art

Engines produce torque by burning a fuel to create engine, and discharge surplus thermal energy. Particularly, a coolant absorbs thermal energy as it circulates through an engine, a heater, and a radiator, and releases the thermal energy.

Oil becomes highly viscous at low engine coolant temperatures. With thick oil, friction and fuel consumption increase, and exhaust gas temperatures rise gradually, lengthening the time taken for catalyst activation and causing deterioration in exhaust gas quality. Moreover, it takes a long time to get a heater to function normally, so passengers and a driver will feel cold.

When the engine coolant temperature is excessively high, knocking may occur. If ignition timing is adjusted to suppress knocking, the engine performance may be degraded. In addition, excessive lubricant temperatures may result in poor lubrication.

However, one coolant control valve is used in specific regions of an engine, and is a valve that controls a number of cooling elements, like keeping the coolant at high temperatures and other regions at low temperatures.

Even with the use of one coolant control valve, an outlet control method for controlling coolants discharged from an engine (a cylinder block and a cylinder head) and an inlet control method for controlling coolants supplied to the engine are generally used.

The outlet control method is vulnerable to abrupt changes in water temperature, exhibits low precision in temperature control, and can decrease the durability of the coolant control valve. Also, the inlet control method works against the cavitation of high-temperature coolants and needs a complicated cooling system structure.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an engine system having a coolant control valve which is beneficial in coping with changes in coolant temperature, which achieves high precision in temperature control, improves valve durability, is good for cavitation, and has a relatively simple cooling system structure.

According to various aspects of the present invention, an engine system having a coolant control valve may include a cylinder block configured with cylinders a cylinder head sitting on top of the cylinder block and comprising exhaust ports and intake ports configured to lead to the cylinders, an Exhaust Gas Recirculation (EGR) cooler, a heater core, an oil cooler, or a radiator through which coolant circulates, and a coolant control valve configured to control a coolant supplied to the cylinder block, a coolant discharged from the cylinder block through the cylinder head, and a coolant supplied to the EGR cooler, the heater core, the oil cooler, or the radiator.

The engine system may further include a coolant pump configured to draw in a coolant discharged from the heater core, the EGR cooler, the oil cooler, or the radiator and configured to pump the coolant to the coolant control valve.

The coolant control valve may include a cylindrical valve that has a pipe structure opened at two ends and having an internal space, and includes coolant passages formed therein at predetermined positions on lateral surfaces, and includes a partition wall formed therein to divide the space into a first chamber and a second chamber on two sides, a valve housing including the cylindrical valve rotatably situated therein, with distribution pipes being connected to the cylinder block, the radiator, the oil cooler, and the EGR cooler/the heater core, respectively, and being connected to the valve housing at positions corresponding to the coolant passages, and having supply pipes being connected to two ends of the valve housing to supply coolant to open regions of the cylindrical valve, and a driving portion that rotates the cylindrical valve on the central longitudinal axis to supply a coolant supplied to the inside of the cylindrical valve to the distribution pipes through the coolant passages.

Sealing members may be interposed between the outer peripheral surface of the cylindrical valve and the valve housing, corresponding to the distribution pipes.

The driving portion may include a motor that exerts torque, a driving gear that rotates by the motor, and a driven gear formed on the outer peripheral surface of one end of the cylindrical valve to rotate in meshing engagement with the driving gear.

The distribution pipes may include a first distribution pipe that is formed corresponding to the first chamber and configured to distribute coolant to the cylinder block through the coolant passage, a second distribution pipe that is formed corresponding to the second chamber and configured to distribute coolant to the radiator through the coolant passages, a third distribution pipe that is formed at one side of the second distribution pipe, corresponding to the second chamber, and configured to distribute coolant to the oil cooler through the coolant passages, and a fourth distribution pipe that is formed at one side of the third distribution pipe, corresponding to the second chamber, and configured to distribute coolant to the EGR cooler or the heater core through the coolant passages.

The engine system may further include a control portion configured to control the driving portion according to coolant temperature.

When the coolant temperature is lower than a first temperature, the control portion may be configured to control the position of rotation of the cylindrical valve in a way that cuts off a coolant supplied to the cylinder block, a coolant discharged from the cylinder head, a coolant supplied to the heater core and the EGR cooler, and a coolant supplied to the radiator.

When the coolant temperature is lower than the first temperature, the control portion may be configured to control the position of rotation of the cylindrical valve in a way that cuts off a coolant supplied to the cylinder block, a coolant discharged from the cylinder head, a coolant supplied to the heater core and the EGR cooler, a coolant supplied to the oil cooler, and a coolant supplied to the radiator.

When the coolant temperature is between the first temperature and a second temperature, the second temperature being higher than the first temperature, the control portion may be configured to control a position of rotation of the cylindrical valve in a way that supplies a coolant to the cylinder block, takes coolant from the cylinder head, supplies a coolant to the heater core and the EGR cooler, and cut off a coolant supplied to the radiator and the oil cooler.

When the coolant temperature is between the second temperature, the second temperature being higher than the first temperature, and a third temperature, the third temperature being higher than the second temperature, the control portion may be configured to control a position of rotation of the cylindrical valve in a way that supplies a coolant to the cylinder block, take a coolant from the cylinder head, supply a coolant to the heater core and the EGR cooler, supply a coolant to the oil cooler, and cut off a coolant supplied to the radiator.

According to various embodiments of the present invention, the benefits of both the inlet control method and the outlet control method can be realized by controlling coolants through both the inlet and the outlet.

Accordingly, an engine system having a coolant control valve is beneficial in coping with changes in coolant temperature, achieves high precision in temperature control, improves valve durability, is good for cavitation, and has a relatively simple cooling system structure.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
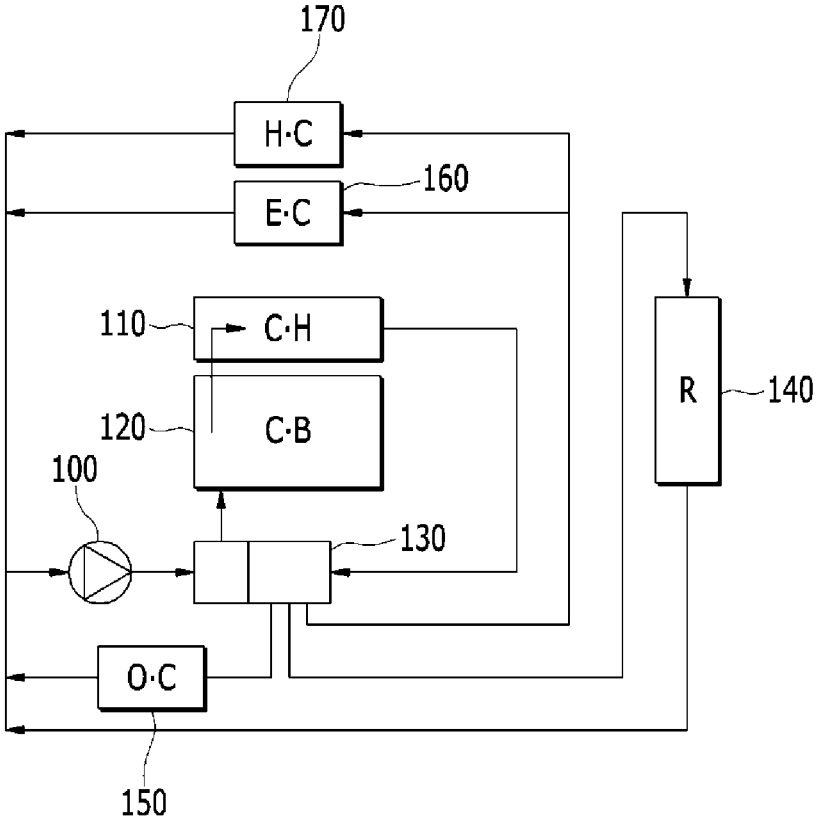
FIG. 1 is a flowchart showing an overall flow of coolant in an exemplary engine system having a coolant control valve according to the present invention.

FIG. 1 is a flowchart showing an overall flow of coolant in an engine system having a coolant control valve according to various embodiments of the present invention.

Referring to FIG. 1, an engine system includes a cylinder head 110, a cylinder block 120, a coolant control valve 130, a coolant pump 100, an oil cooler 150, a heater core 170, an Exhaust Gas Recirculation (EGR) cooler 160, and a radiator 140.

Cylinders each having a piston seated therein are formed in the cylinder block 120, and the cylinder head 100 fits on top of the cylinder block 120 and includes intake ports and exhaust ports that are connected to the cylinders. Outside air is drawn in through the intake ports, and exhaust gases burned within the cylinder are discharged through the exhaust ports.

The heater core 170 functions to heat the air in the vehicle by using a hot coolant supplied to it, and the EGR cooler 160 functions to cool exhaust gases recirculated from an exhaust line to an intake line.

The oil cooler 150 functions to cool oil circulating through the cylinder head 110 and the cylinder block 120, and the radiator 140 functions to release thermal energy from the coolant.

In various embodiments of the present invention, a coolant pumped from the coolant pump 100 is supplied to the coolant control valve 130, and the coolant control valve 130 distributes the coolant to the cylinder block 120, the oil cooler 150, the EGR cooler 160, the heater core 170, and the radiator 140.

The coolant supplied to the cylinder block 120 cools down the cylinder block 120, and is then supplied to the cylinder head 110. The coolant supplied to the cylinder head 110 is discharged as it cools down the cylinder head 110, and the coolant discharged from the cylinder head 110 is not recirculated by the coolant pump 100 but instead is recirculated directly through the coolant control valve 130.

In various embodiments of the present invention, the coolant control valve 130 may control both a coolant supplied to the cylinder block 120 and the cylinder head 110 and a coolant discharged from the cylinder head 110 and the cylinder block 120 at the same time.

With the above-described configuration, the benefits of both the inlet control method and the outlet control method can be realized by controlling coolants through both the inlet and the outlet.

Figure 2:
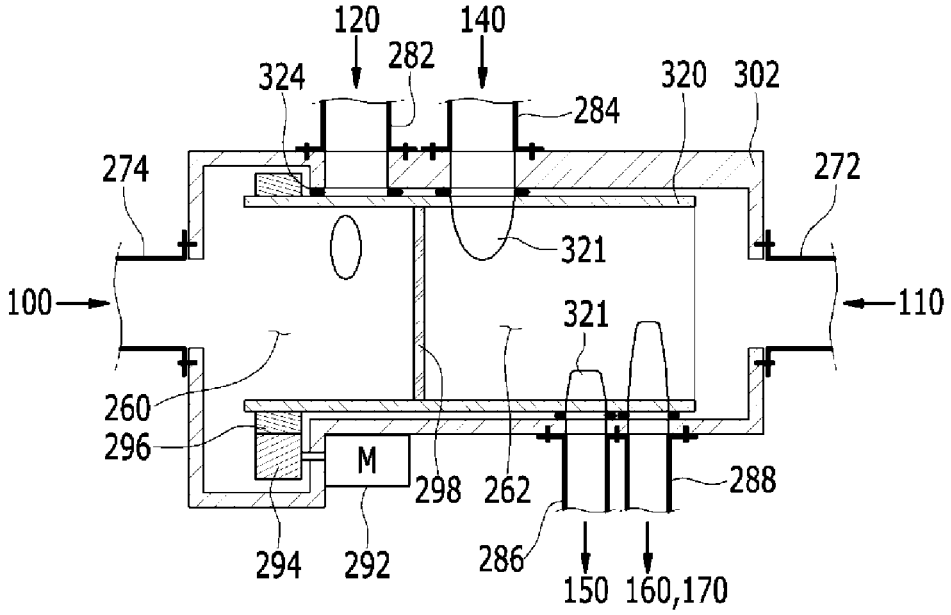
FIG. 2 is a partial schematic cross-sectional view of a coolant control valve according to the present invention.

FIG. 2 is a partial schematic cross-sectional view of a coolant control valve according to various embodiments of the present invention.

Referring to FIG. 2, the coolant control valve 130 includes a valve housing 302, a cylindrical valve 320, a driven gear 296, a driving gear 294, a motor 292, and sealing members 324.

The cylindrical valve 320 has a pipe structure opened at both ends and having an internal space, and includes a partition wall 298 in the middle that longitudinally divides the space into a first chamber 260 and a second chamber 262.

Coolant passages 321 are formed in the cylindrical valve 320, corresponding to the first chamber 260 and the second chamber 262. As illustrated therein, one coolant passage 321 is formed corresponding to the first chamber 260, and three coolant passages 321 are formed corresponding to the second chamber 262.

The cylindrical valve 320 is rotatably situated in the valve housing 302, and the valve housing 302 is connected to a first distribution pipe 282, corresponding to the coolant passage 321 of the first chamber 260.

Moreover, the valve housing 302 is connected to a second distribution pipe 284, a third distribution pipe 286, and a fourth distribution pipe 288, corresponding to the coolant passages 321 of the second chamber 262, and the sealing members 324 are interposed between the inner peripheral surface of the valve housing 302 and the outer peripheral surface of the cylindrical valve 320 to control coolant flow with more precision.

A first supply pipe 274 is connected to one end of the valve housing 302 to supply coolant to an open region of the first chamber 260 of the cylindrical valve 320, and a second supply pipe 272 is connected to the other end of the valve housing 302 to supply coolant to an open region of the second chamber 262 of the cylindrical valve 320.

In various embodiments of the present invention, the first supply pipe 274 takes coolant from the coolant pump 100, and the second supply pipe 272 takes coolant from the cylinder head 110.

The coolant supplied from the coolant pump 100 through the first supply pipe 274 is supplied to the first chamber 260 of the cylindrical valve 320 through the first supply pipe 274 and then supplied to the cylinder block 120 through the coolant passage 321 and the first distribution pipe 282.

The coolant supplied from the cylinder head 110 through the second supply pipe 272 is supplied to the second chamber 262 of the cylindrical valve 320 through the second supply pipe 272 and then supplied to the radiator 140, the oil cooler 150, and the EGR cooler 160/the heater core 170 through the coolant passages 321 and the second, third, and fourth distribution pipes 284, 286, and 288.

The driven gear 296 is formed on the outer peripheral surface of one end of the cylindrical valve 320, the driven gear 296 meshes with the driving gear 294, and the motor 292 is mounted to the valve housing 302 to rotate the driving gear 294.

A control portion controls the position of rotation of the cylindrical valve 320 through the driving gear 294 and the driven gear 296 by controlling the motor 292. The coolant passages 321 correspond to the first distribution pipe 282, the second distribution pipe 284, the third distribution pipe 286, or the fourth distribution pipe 288, depending on the position of rotation of the cylindrical valve 320, thereby distributing coolant through these pipes, respectively.

In various embodiments of the present invention, when the coolant temperature is equal to or lower than a first temperature where coolant is cool, the coolant control valve 130 cut off coolant supply to the EGR cooler 160, the heater core 170, the radiator 140, the oil cooler 150, and the cylinder block 120.

Figure 3:
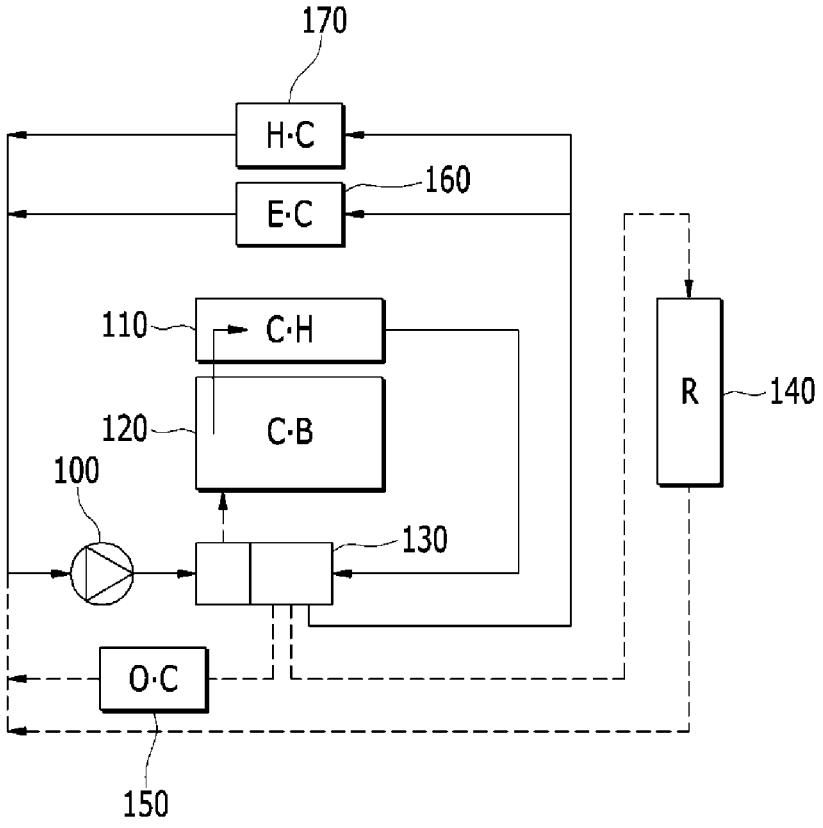
FIG. 3 is a flowchart showing a flow of coolant under a first temperature condition in an exemplary engine system having a coolant control valve according to the present invention.

FIG. 3 is a flowchart showing a flow of coolant under a first temperature condition in an engine system having a coolant control valve according to various embodiments of the present invention.

Referring to FIG. 3, when the coolant temperature is equal to or lower than a second temperature (during warm-up), which is higher than the first temperature, the coolant control valve 130 supplies coolant to the cylinder block 120 and takes coolant from the cylinder head 110. Moreover, the coolant control valve 130 distributes coolant to the EGR cooler 160 and the heater core 170.

Figure 4:
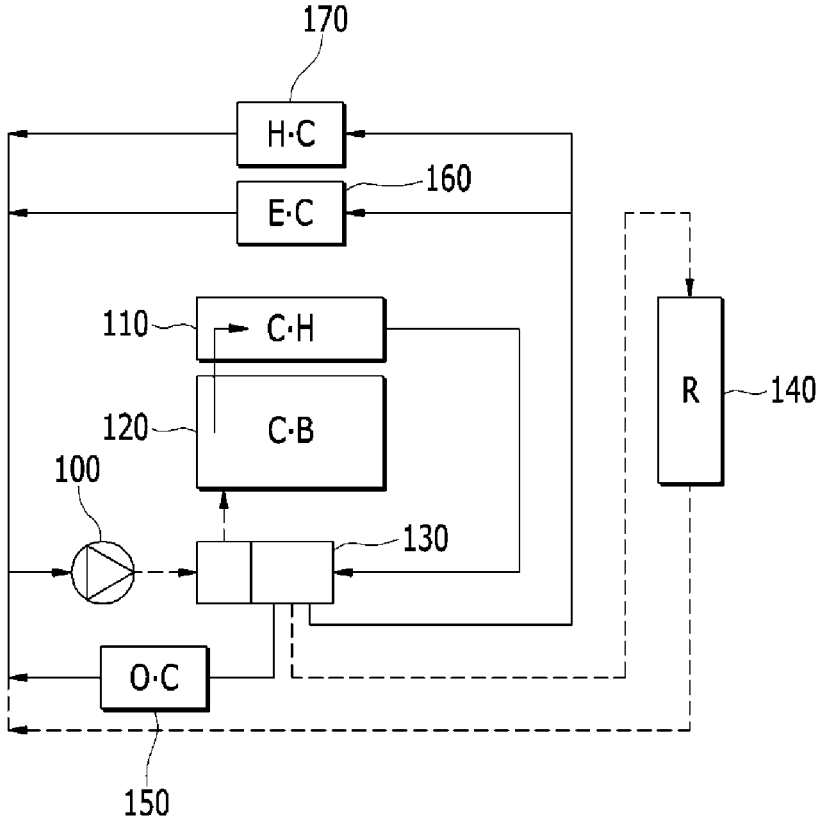
FIG. 4 is a flowchart showing a flow of coolant under a second temperature condition in an exemplary engine system having a coolant control valve according to the present invention.

FIG. 4 is a flowchart showing a flow of coolant under a second temperature condition in an engine system having a coolant control valve according to various embodiments of the present invention.

Referring to FIG. 4, when the coolant temperature is equal to or lower than a third temperature (after warm-up), which is higher than the second temperature, the coolant control valve 130 supplies coolant to the cylinder block 120 and takes coolant from the cylinder head 110. Moreover, the coolant control valve 130 distributes coolant to the EGR cooler 160, the heater core 170, and the oil cooler 150.

In addition, in various embodiments of the present invention, when the coolant temperature is equal to or higher than the third temperature where coolant is hot, the coolant control valve 130 supplies coolant to the EGR cooler 160, the heater core 170, the radiator 140, the oil cooler 150, and the cylinder block 120.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine system having a coolant control valve, the engine system comprising:

a cylinder block having cylinders;

a cylinder head sitting on top of the cylinder block and comprising exhaust ports and intake ports configured to lead to the cylinders;

an Exhaust Gas Recirculation (EGR) cooler, a heater core, an oil cooler, or a radiator through which coolant circulates; and a coolant control valve configured to control a coolant supplied to the cylinder block, a coolant discharged from the cylinder block through the cylinder head, and a coolant supplied to the EGR cooler, the heater core, the oil cooler, or the radiator.

2. The engine system of claim 1, further comprising a coolant pump configured to draw in a coolant discharged from the heater core, the EGR cooler, the oil cooler, or the radiator and configured to pump the coolant to the coolant control valve.

3. The engine system of claim 2, wherein the coolant control valve comprises:

a cylindrical valve that has a pipe structure opened at two ends and having an internal space, comprises coolant passages formed therein at predetermined positions on lateral surfaces, and comprises a partition wall formed therein to divide the internal space into a first chamber and a second chamber on two sides;

a valve housing comprising the cylindrical valve rotatably situated therein, with distribution pipes being connected to the cylinder block, the radiator, the oil cooler, and the EGR cooler/the heater core, respectively, and being connected to the valve housing at positions corresponding to the coolant passages, and having supply pipes being connected to two ends of the valve housing to supply coolant to open regions of the cylindrical valve; and a driving portion that rotates the cylindrical valve on a central longitudinal axis to supply a coolant supplied to the inside of the cylindrical valve to the distribution pipes through the coolant passages.

4. The engine system of claim 3, wherein sealing members are interposed between an outer peripheral surface of the cylindrical valve and the valve housing, corresponding to the distribution pipes.

5. The engine system of claim 3, wherein the driving portion comprises:

a motor that exerts torque;

a driving gear that rotates by the motor; and a driven gear formed on an outer peripheral surface of a first end of the cylindrical valve to rotate in meshing engagement with the driving gear.

6. The engine system of claim 3, wherein the distribution pipes comprise:

a first distribution pipe that is formed corresponding to the first chamber and configured to distribute coolant to the cylinder block through the coolant passage;

a second distribution pipe that is formed corresponding to the second chamber and configured to distribute coolant to the radiator through the coolant passages;

a third distribution pipe that is formed at a side of the second distribution pipe, corresponding to the second chamber, and configured to distribute coolant to the oil cooler through the coolant passages; and a fourth distribution pipe that is formed at a side of the third distribution pipe, corresponding to the second chamber, and configured to distribute coolant to the EGR cooler or the heater core through the coolant passages.

7. The engine system of claim 3, further comprising a control portion configured to control the driving portion according to a coolant temperature.

8. The engine system of claim 7, wherein, when the coolant temperature is lower than a first temperature, the control portion is configured to control a position of rotation of the cylindrical valve in a way that cuts off a coolant supplied to the cylinder block, a coolant discharged from the cylinder head, a coolant supplied to the heater core and the EGR cooler, and a coolant supplied to the radiator.

9. The engine system of claim 7, wherein, when the coolant temperature is lower than the first temperature, the control portion is configured to control the position of rotation of the cylindrical valve in a way that cuts off a coolant supplied to the cylinder block, a coolant discharged from the cylinder head, a coolant supplied to the heater core and the EGR cooler, a coolant supplied to the oil cooler, and a coolant supplied to the radiator.

10. The engine system of claim 7, wherein, when the coolant temperature is between the first temperature and a second temperature, the second temperature being higher than the first temperature, the control portion is configured to control a position of rotation of the cylindrical valve in a way that supplies a coolant to the cylinder block, takes coolant from the cylinder head, supplies a coolant to the heater core and the EGR cooler, and cut off a coolant supplied to the radiator and the oil cooler.

11. The engine system of claim 7, wherein, when the coolant temperature is between the second temperature, the second temperature being higher than the first temperature, and a third temperature, the third temperature being higher than the second temperature, the control portion is configured to control a position of rotation of the cylindrical valve in a way that supplies a coolant to the cylinder block, take a coolant from the cylinder head, supply a coolant to the heater core and the EGR cooler, supply a coolant to the oil cooler, and cut off a coolant supplied to the radiator.

* * * * *